US006672465B2

(12) United States Patent
White et al.

(10) Patent No.: US 6,672,465 B2
(45) Date of Patent: Jan. 6, 2004

(54) TELEVISION STAND

(75) Inventors: Jeffrey A. White, Carlsbad, CA (US); Susan L. Farrell, Carlsbad, CA (US)

(73) Assignee: Rite Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 10/004,593

(22) Filed: Dec. 4, 2001

(65) Prior Publication Data

US 2003/0102781 A1 Jun. 5, 2003

(51) Int. Cl.[7] ..... A47F 5/00

(52) U.S. Cl. ..... 211/186; 211/188; 211/135; 108/106; 108/50.02

(58) Field of Search ..... 211/26, 135, 186, 211/187, 188; 108/106, 107, 50.02; 312/265.4

(56) References Cited

U.S. PATENT DOCUMENTS

D244,983 S * 7/1977 Iida
4,108,514 A * 8/1978 Zimmerman
4,202,586 A * 5/1980 Oplinger ..... 211/188 X
4,949,648 A * 8/1990 Miller
4,967,916 A * 11/1990 Handler et al. ..... 211/186 X
5,039,044 A * 8/1991 Sher
5,749,304 A * 5/1998 Turner
5,957,060 A * 9/1999 Rosenband ..... 108/107
6,135,583 A * 10/2000 Simon et al. ..... 108/50.02 X
6,230,909 B1 * 5/2001 Suter ..... 211/188
2002/0179552 A1 * 12/2002 Marraffa ..... 211/49.1

* cited by examiner

*Primary Examiner*—Robert W. Gibson, Jr.
(74) *Attorney, Agent, or Firm*—Marshall, Gerstein & Borun LLP

(57) ABSTRACT

A television stand includes a shelf made of a ferrous sheet metal that helps shield a television or other audio/video items from the magnetic field of a nearby center-channel speaker. Other features of the stand include an open design to promote natural, convective airflow that helps cool audio/video components; numerous parts sharing a common material thickness for ease of manufacture; infinitely repositionable center supports; combination cable collector and bumper; metal grain-like finish with a clear protective coating; shelves and side panels with integral flanges for stiffness and/or mounting purposes; and the use of acorn nuts for not only fastening, but also for helping to prevent the television from being accidentally slid off the top shelf of the stand.

24 Claims, 7 Drawing Sheets

TELEVISION STAND

BACKGROUND OF THE INVENTION

1. Field of the Invention

The subject invention generally pertains to furniture and more specifically to a television stand.

2. Description of Related Art

The current trend in home entertainment centers is to emulate more closely the effects provided by big screen movie theaters. Larger and heavier televisions are becoming more common, and their sound systems are becoming more sophisticated.

Commercial movie theaters often have several speakers that project various channels of sound. Some speakers may be positioned near the front of the theater, off to the right and left side of the screen. Others, such as right and left side speakers, may be near the back of the theater to create what is known as surround-sound. Such speakers may carry different channels of background sound to create various effects, such as a distant sound coming from a particular direction or a traveling source of sound.

In addition, commercial theaters often include a center-channel speaker positioned directly behind the movie screen. The screen, then, is made of a material that allows the sound from the speaker to pass right through the screen. Center-channel speakers typically carry the dialogue, so that the voices seem to come directly from the projected image of the actors and actresses of the movie.

This same effect is more difficult to achieve at home with a television having an impermeable picture tube rather than a screen. Instead of mounting a center-channel speaker behind the tube, the speaker is usually placed directly below the television, with the two being placed as close together as possible. Unfortunately, speakers often have powerful magnets whose magnetic field, when too close to the television, may distort the image on the set. Due to the magnetic field, the center-channel speaker may need to be placed farther away from the television than what would otherwise be necessary, which diminishes the desired illusion of having the sound come directly from the picture.

Also, when a large, heavy television is placed on a shelf with the center-channel speaker beneath it, the reinforcing shelf structure needed to support the weight of the television may further limit how close the speaker and television can be placed. This is especially true when the shelf is made of wood, particleboard, or a similarly weak material, because with weaker materials more structural support is needed.

Television cabinets are also often used to store other audio and video related items, such radio receivers, amplifiers, and tape players and their tapes. Wooden cabinets with relatively low thermal conductivity may promote overheating of certain electrical components, such as power amplifiers. And recorded information on tapes may get damaged if the tape gets exposed to the magnetic field of the center-channel speaker.

SUMMARY OF THE INVENTION

In some embodiments, a television stand includes a shelf made of metal for providing strength without adding excessive bulk; as such bulk may limit how close a center-channel speaker may be placed next to a television.

In some embodiments, a television stand includes a shelf made of ferrous metal for magnetically shielding various audio/video equipment from the magnetic field of a speaker.

In some embodiments, a television stand includes a shelf made of metal to promote the dissipation of heat away from various audio/video equipment.

In some embodiments, a television stand includes a sanded metal surface protected by a clear coating to give the stand a smooth grain-like finish.

In some embodiments, a television stand is bolted together using acorn nuts that protrude upward from a shelf to help prevent a television from sliding off the shelf upon being accidentally bumped.

In some embodiments, a television stand includes numerous sheet metal parts of the same material thickness. This minimizes scrap, as the various parts can be efficiently arranged or nested among themselves prior to cutting them from a single piece of sheet metal.

In some embodiments, a television stand includes numerous sheet metal parts of the same material thickness to avoid having to adjust the settings of a sanding machine.

In some embodiments, a television stand includes side panels with numerous openings that promote natural airflow, which helps prevent audio/video components from overheating.

In some embodiments, a television stand has a hexagonal footprint with beveled back corners that allow the stand to be selectively placed alongside a flat wall or tucked into a corner of a room.

In some embodiments, a television stand includes a central support that is frictionally pressed between two shelves or between a base and an upper shelf. This renders the central support infinitely repositionable.

In some embodiments, a television stand includes a cable guard that neatly manages a number of cables, so that only a relatively narrow back panel is needed to hide the cables.

In some embodiments, a television stand includes a cable guard that not only manages a number of cables, but also serves as a protective bumper that helps protect the cables from being crushed against a wall.

In some embodiments, a television stand includes a first upper side panel spaced apart from a first lower side panel with a middle shelf interposed therebetween, so that the middle shelf is clamped solidly between the two side panels with a series of common bolts (i.e., each bolt extends through all three parts: the middle shelf and the two side panels).

DESCRIPTION OF THE PREFERRED EMBODIMENT

Figure 1:
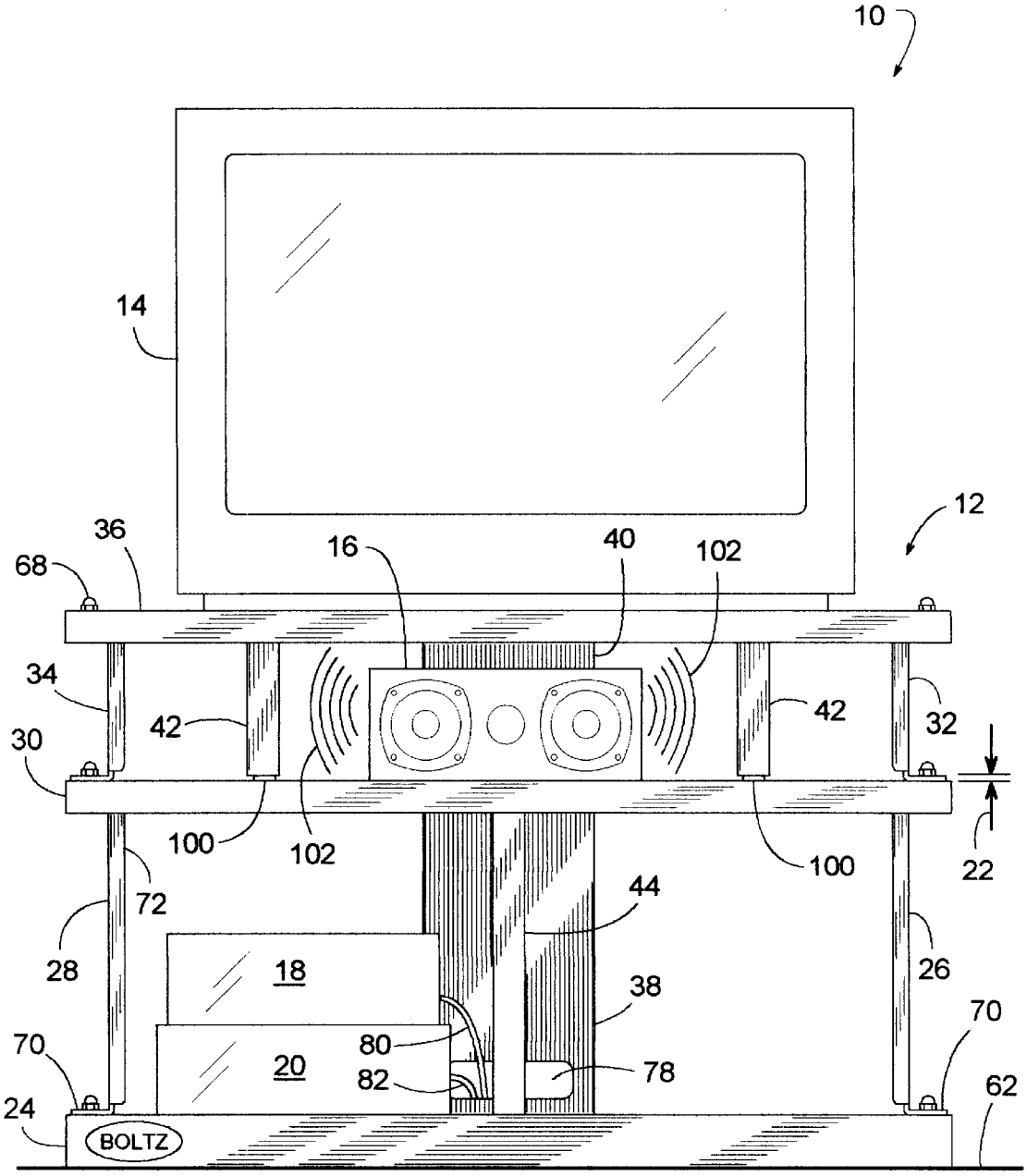
FIG. 1 is a front view of a three-tier television stand supporting various audio/video items.
Figure 2:
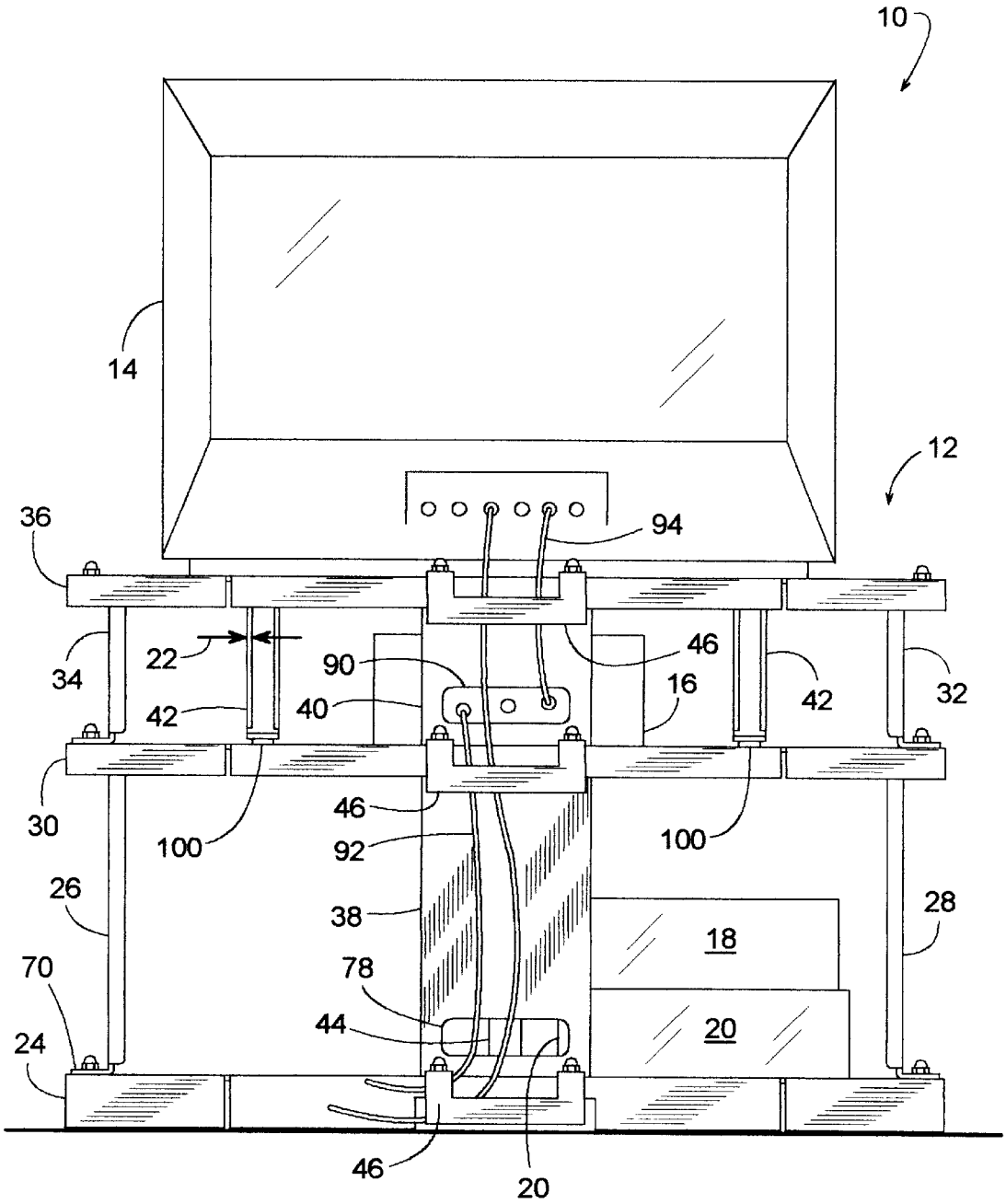
FIG. 2 is a back view of the stand of FIG. 1.
Figure 3:
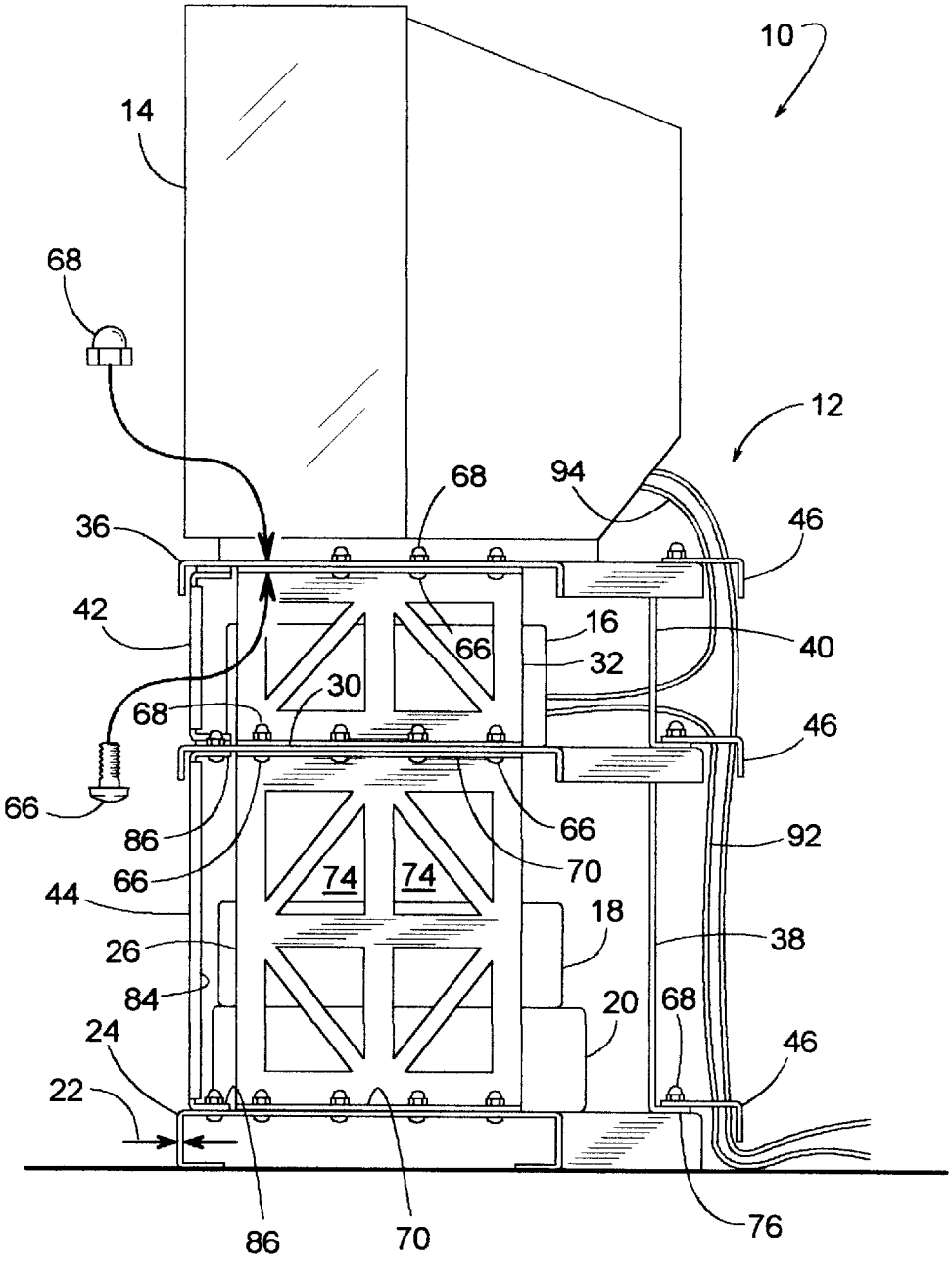
FIG. 3 is a right side view of the stand of FIG. 1, but also showing an enlarged exploded view of a typical screw and nut being assembled.

A television stand system 10, shown in FIGS. 1–3, includes a stand 12 made of a ferrous sheet metal to effectively support, magnetically shield, and ventilate various audio/video components. In this example, stand 12 supports a television 14 and a center-channel speaker 16. The term, "center-channel speaker" refers to any type of speaker having a magnetic field. Stand 12 may also support other items 18 and 20, which are schematically illustrated to represent various other audio/video components, examples of which include, but are not limited to, a radio receiver, television, amplifier, tape player, CD player, DVD player, and magnetic tapes.

Figure 4:
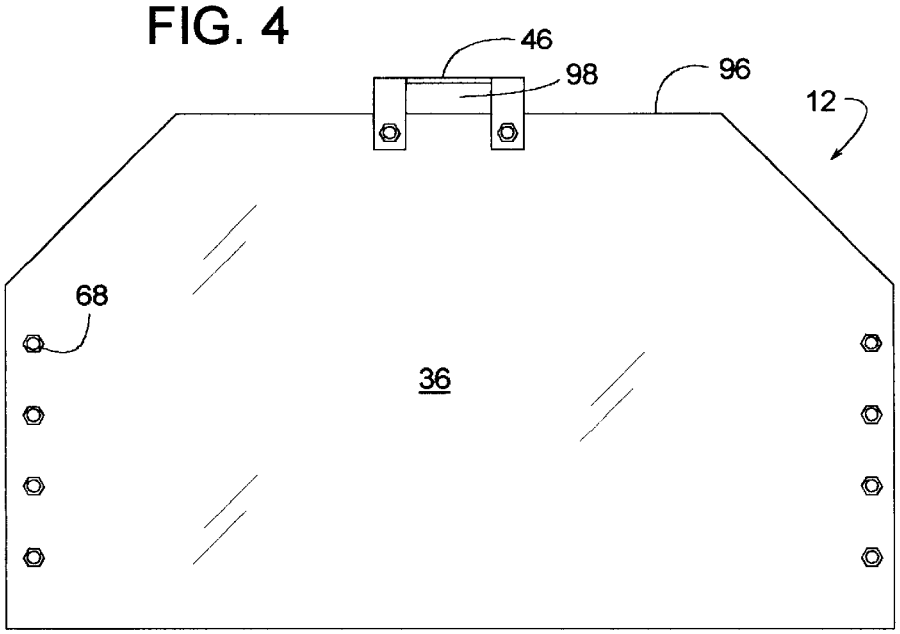
FIG. 4 is a top view of the stand in FIG. 1, but with the various audio/video items omitted.
Figure 5:
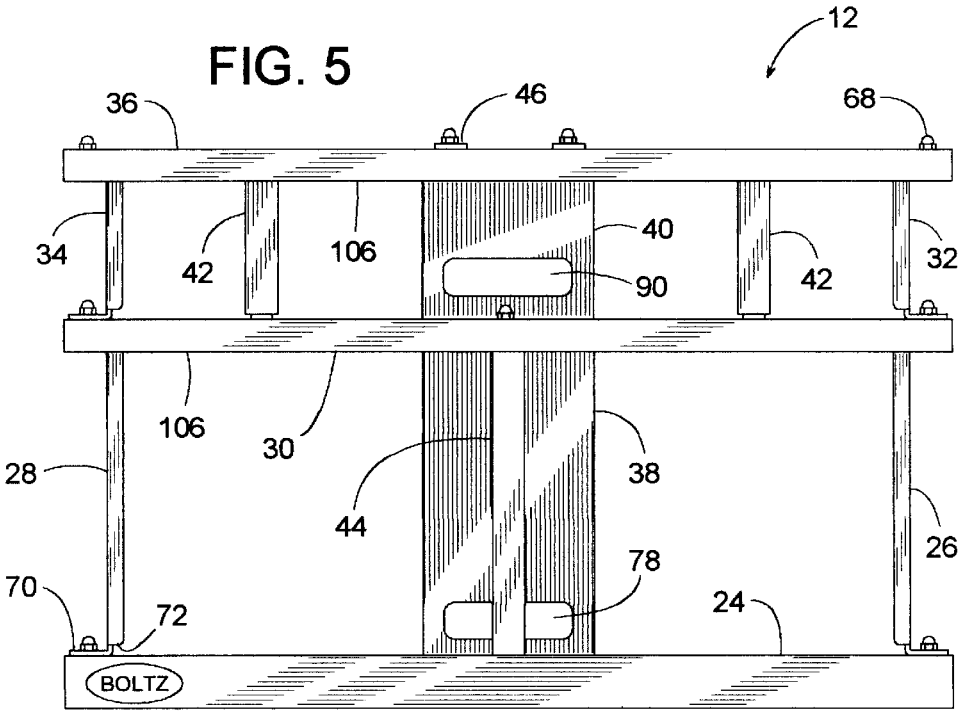
FIG. 5 is a front view of the stand in FIG. 4.

To facilitate its manufacture, reduce its cost, and enhance its appearance, stand 12 is primarily comprised of formed sheet metal components of a substantially common material thickness 22 (e.g., 10 gage). In some embodiments, the components that have a similar material thickness include a base 24, a first lower side panel 26, a second lower side panel 28, a middle shelf 30, a first upper side panel 32, a second upper side panel 34, a top shelf 36, a lower back panel 38, an upper back panel 40, three central supports 42 and 44, and three cable guards 46. Some of the component parts of stand 12 are more clearly shown with the various audio/video components removed, as shown in FIG. 4 (top view), FIG. 5 (front view), FIG. 6 (back view), FIG. 7 (bottom view), and FIG. 8 (right side view, which is a mirror image of the left side view).

Viewed from the top or bottom (e.g., FIG. 7), base 24 has a generally hexagonal shape with two 90-degree angles 48 and 50, and two pairs of parallel sides: 52 and 54, and 56 and 58. The same is true for middle shelf 30 and top shelf 36. Such a shape allows the rear of stand 12 to be neatly placed alongside a straight wall or tucked into a corner of a room. Base 24 includes L-shaped flanges 60 (FIGS. 7 and 8) that provide base 24 with rigidity and provide an appreciable footprint for setting stand 12 on a floor 62. Flanges 60 may also be provided with holes 64 (FIG. 7) for installing casters or skid pads.

Figure 10:
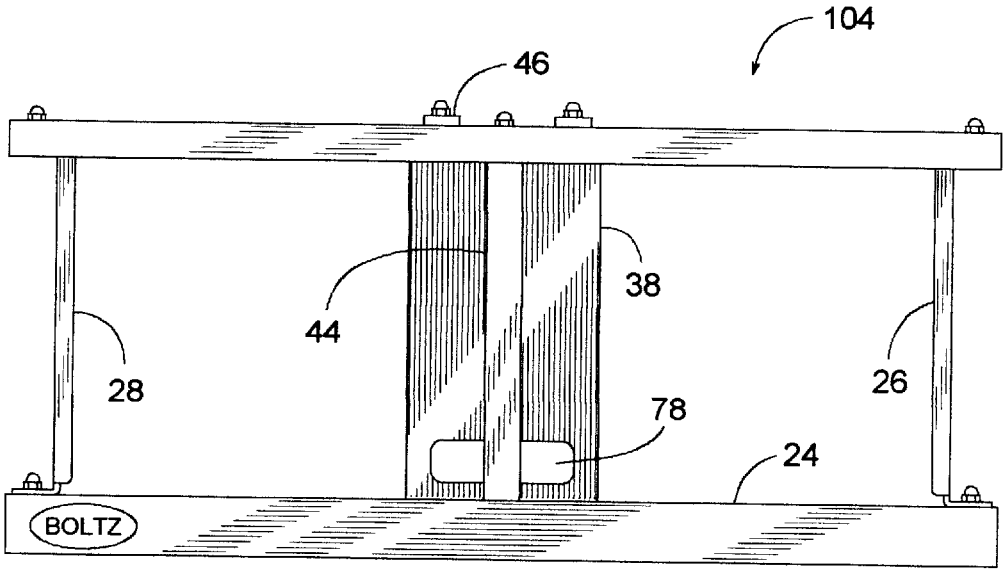
FIG. 10 is front view of a two-tier television stand.
Figure 11:
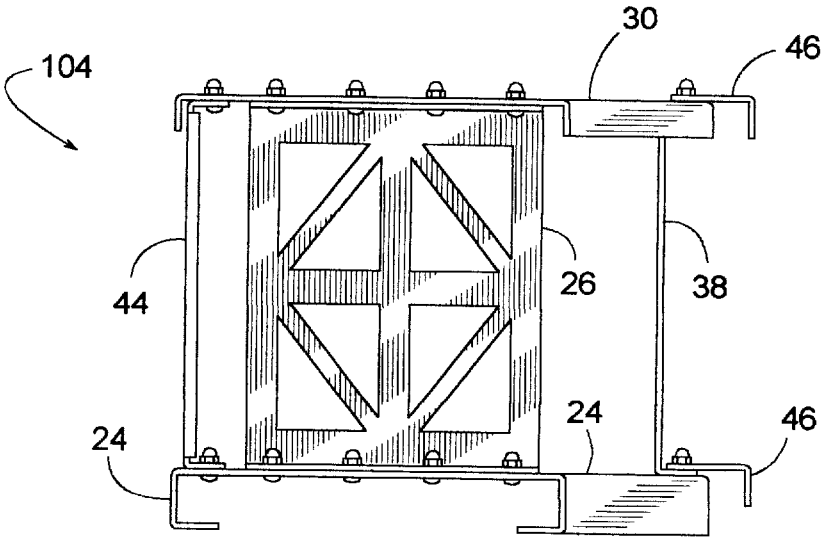
FIG. 11 is a side view of the stand of FIG. 10.

To support middle shelf 30 (or an upper shelf of a two-shelf stand, as shown in FIGS. 10 and 11), lower side panels 26 and 28, lower back panel 38, and central support 44 are bolted to base 24 and middle shelf 30. The term, "bolted" refers to fastening by way of any type of threaded fastener (e.g., machine screw, bolt, self-tapping screw, etc.). In some embodiments, many of the component parts of stand 12 are bolted together using an externally threaded button head cap screw 66 and an internally threaded acorn nut 68 (see FIG. 3).

Figure 8:
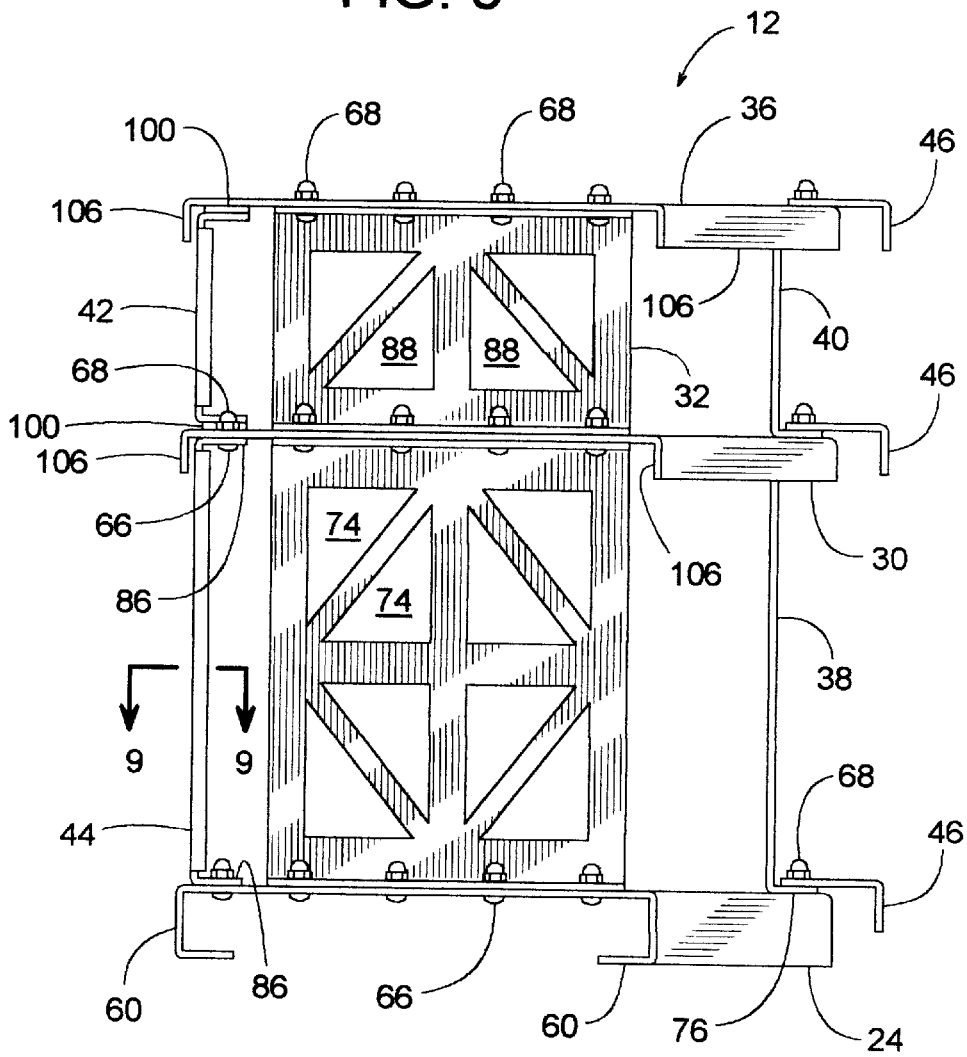
FIG. 8 is the side view of the stand in FIG. 5.

To bolt side panels 26 and 28 in place, the side panels are formed to include a plurality of mounting flanges 70, which are provided with a set of bolt holes that correspond to a matching set of holes in base 24 and middle shelf 30. Side panels 26 and 28 also include edge flanges 72 for stiffness (FIG. 5), and a plurality of openings 74 to facilitate natural airflow by convection (FIG. 8). Such airflow may help in cooling certain audio/video components that may be stored on stand 12.

Back panel 38 is formed to include mounting flanges 76 and is bolted in place in a manner similar to that of side panels 26 and 28. Back panel 38 includes an opening 78 through which electrical cables 80 and 82 may be run to perhaps items 18 and 20 (FIG. 1).

Figure 9:
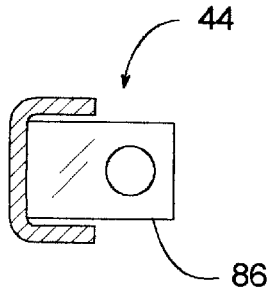
FIG. 9 is a cross-sectional view taken along line 9—9 of FIG. 8.

Central support 44 includes two edge flanges 84 for stiffness (FIGS. 3 and 6) and two end flanges 86 (FIGS. 3, 8 and 9) with bolt holes for bolting support 44 to base 24 and middle shelf 30.

To support top shelf 36, upper side panels 32 and 34, and upper back panel 40 are bolted to middle shelf 30 and top shelf 36 in a manner similar to that of lower side panels 26 and 28, and lower back panel 38. This provides a plurality of acorn nuts 68 that protrude upward from top shelf 36, which helps prevent television 14 from accidentally sliding off stand 12. A single bolt 66 (i.e., a common bolt) extending through aligned bolt holes in middle shelf 30 and upper and lower side panels can bolt all three of those component parts together. Upper side panels 32 and 34 include a plurality of openings 88 (FIG. 8) for airflow, and upper back panel 40 includes an opening 90 for electrical cables 92 and 94 (FIGS. 2 and 3).

Figure 6:
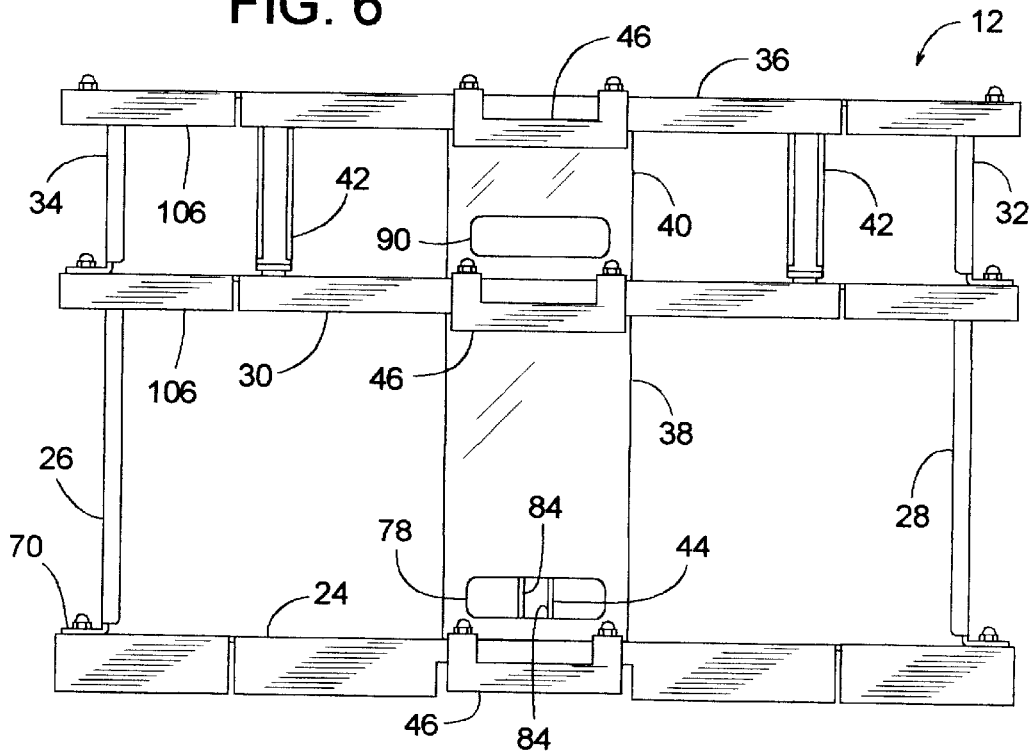
FIG. 6 is a back view of the stand in FIG. 5.
Figure 7:
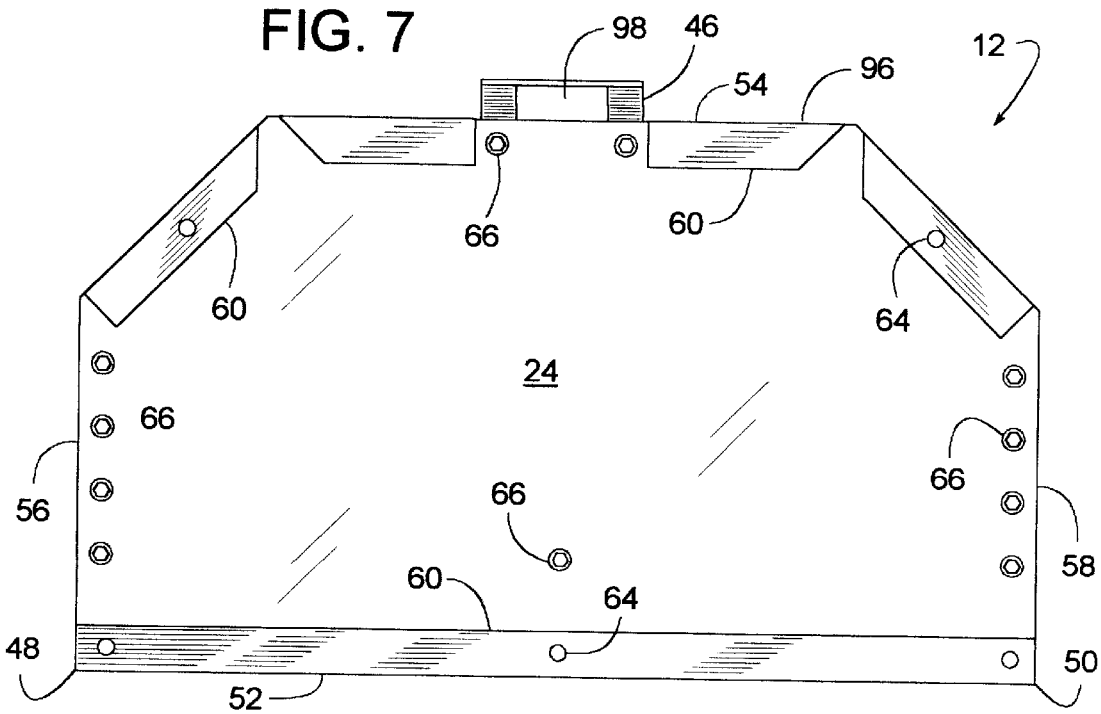
FIG. 7 is a bottom view of the stand in FIG. 5.

Additional protection and management of electrical cables can be provided by cable guards 46, with one each being bolted to base 24 and shelves 30 and 36. Cable guards 46 are formed as shown in FIGS. 6, 7 and 8, and each include two bolt holes for mounting to their respective shelf or base. When mounted to protrude horizontally beyond an outer perimeter 96 of base 24, middle shelf 30 or top shelf 36, each cable guard 46 provides a cable-receiving opening 98 (i.e., an upper, middle and lower one) through which cables 80, 82, 92 or 94 may extend.

To further support top shelf 36, two central supports 42 may be installed between top shelf 36 and middle shelf 30. Except for their length, supports 42 are similar to support 44. Supports 42 may be bolted in place; however, they are preferably held in position frictionally, so the space between them can be readily adjusted to accommodate whatever speaker or component may be placed between them. To frictionally grip supports 42 between middle shelf 30 and top shelf 36, a resilient button or pad 100 (e.g, rubber, neoprene, vinyl, etc.) is disposed at opposite ends of each support 42 (FIG. 8). A high frictional force is created when pad 100 is pressed against one of the shelves.

Referring to FIG. 8, middle shelf 30 extending fully between the upper and lower side panels holds middle shelf 30 solidly in place. It would be very difficult for a weight or some other downward force acting on middle shelf 30 to force middle shelf 30 off its supporting lower side panels 26 and 28. In contrast, if the upper and lower side panels were not separated by middle panel 30, but instead were a single extra tall side panel extending all the way from base 24 to top shelf 36 with middle shelf 30 connected at some intermediate height, then middle shelf 30 may be more susceptible to being dislodged by a downward force.

With television 14 resting on top shelf 36 and with speaker 16 on middle shelf 30, top shelf 36 is preferably made of a ferrous metal (e.g., mild steel sheet metal) to help shield television 14 from the adverse effects of a magnetic field 102 from speaker 16. Middle shelf 30 is also preferably made of a ferrous metal to help shield items 18 and 20 from that same magnetic field.

The upper portion of stand 12 can be removed to create a two-tier stand 104, as shown in FIGS. 10 and 11. In this case, middle shelf 30 now serves as an upper shelf (i.e., a shelf above the base). A television can be placed on shelf 30 and a speaker 16 (or other audio/video items 18 or 20) can be placed on base 24, or vice versa.

The manufacturing processes to produce the component parts of stands 12 and 104 may vary. Currently, the parts are first laser cut from generally flat sheet metal to create the part's outer edges and bolt holes. Alternatively, the parts can be sheared, blanked, machined and/or drilled with hard tooling. The initially flat parts are then fed across one or between two sanding belts that remove burrs and scale and leaves a grain-like surface finish on the face of the parts. Next, a brake press forms the parts to create various flanges for part stiffness, mounting, and other utility. For example, shelves 30 and 36 have a peripheral flange 106 (FIG. 8) that increases the shelves' rigidity. With the assistance of an electrostatic charge, a powder paint composition, consisting of a thermosetting resin, is then sprayed over the surface of the parts. The powder paint is preferably clear to preserve the beauty of the metal's grain-like finish; however, the powder paint may also be tinted or opaque. Next, the parts are heated to over 300-degrees Fahrenheit or to a temperature that hardens the thermosetting resin of the powder paint. For ease of handling and shipping, the component parts of a single stand are grouped and shipped in at least two boxes to a customer. The customer then assembles the parts to create a finished stand and installs the various audio/video items.

Although the invention is described with reference to a preferred embodiment, it should be appreciated by those skilled in the art that various modifications are well within the scope of the invention. For example, instead of bolting center support 44 in place, pad 100 can be readily installed at each end of center support 44, so that support 44 can be frictionally held between base 24 and shelf 30 in the same manner that supports 42 are held between shelves 30 and 36. Conversely, supports 42 can be bolted in place instead of using pads 100. Therefore, the scope of the invention is to be determined by reference to the claims that follow.

We claim:

1. A television stand for supporting at least one of a television and a center-channel speaker, comprising:

a base;

a first side panel disposed on top of the base and being bolted thereto;

a second side panel disposed on top of the base and being bolted thereto;

an upper shelf bolted on top of the first side panel and on top of the second side panel and being made of a ferrous metal able to help shield a magnetic field; and a plurality of mounting flanges extending substantially perpendicular from the first side panel and the second side panel and lying substantially parallel to the base and the upper shelf, wherein the plurality of mounting flanges facilitate bolting the first side panel and the second side panel to the base and the upper shelf.

2. The television stand of claim 1, wherein the upper shelf is interposed between the television and the center-channel speaker.

3. The television stand of claim 1, wherein the base, the upper shelf, the first side panel, the second side panel, and the plurality of mounting flanges all have a substantially equivalent material thickness.

4. The television stand of claim 1, wherein the first side panel and the second side panel each define a plurality of openings to facilitate natural airflow therethrough.

5. The television stand of claim 1, further comprising a plurality of acorn nuts protruding upward from the upper shelf to help prevent the television from sliding off the upper shelf and to help bolt the upper shelf to the first side panel and the second side panel.

6. The television stand of claim 1, wherein the upper shelf defines a hexagon with two substantially 90-degree angles and two pairs of substantially parallel sides.

7. The television stand of claim 1, wherein the base defines a hexagon with two substantially 90-degree angles and two pairs of substantially parallel sides.

8. The television stand of claim 1, further comprising a central support that includes an upper end pressed up against the upper shelf and a lower end pressed down against the base to help support the upper shelf.

9. The television stand of claim 8, further comprising a resilient pad disposed at each of the upper end and the lower end of the central support to help hold the central support frictionally between the base and the upper shelf.

10. The television stand of claim 8, wherein the central support has a material thickness that is substantially equivalent to that of the base and the upper shelf.

11. The television stand of claim 1, further comprising a back panel disposed on top of the base and being bolted to the base and the upper shelf; and further comprising a cable guard bolted to the back panel and the base, wherein the cable guard defines a cable-receiving opening and protrudes horizontally beyond an outer perimeter of the base.

12. A television stand for supporting a television, comprising:

a base;

a first lower side panel resting on top of the base and being bolted thereto;

a second lower side panel resting on top of the base and being bolted thereto;

a middle shelf resting on top of the first lower side panel and on top of the second lower side panel, wherein the middle shelf is bolted to the first lower side panel and the second lower side panel;

a first upper side panel resting on top of the middle shelf and being bolted thereto, wherein the first upper side panel is above but space apart from the first lower side panel;

a second upper side panel resting on top of the middle shelf and being bolted thereto, wherein the second upper side panel is above but spaced apart from the second lower side panel;

a top shelf resting on top of the first upper side panel and on top of the second upper side panel wherein the top shelf is bolted to the first upper side panel and the second upper side panel; and a plurality of mounting flanges lying substantially parallel to the base, the middle shelf and the top shelf, wherein the plurality of mounting flanges extend outward from the first lower side panel, the second lower side panel, the first upper side panel and the second upper side panel, wherein the plurality of mounting flanges facilitate bolting the first lower side panel, the second lower side panel, the first upper side panel and the second upper side panel to at least one of the base, the middle shelf and the top shelf.

13. The television stand of claim 12, wherein the base, the middle shelf, the top shelf, the first lower side panel, the second lower side panel, the first upper side panel, the second upper side panel, and the plurality of mounting flanges all have a substantially equivalent material thickness.

14. The television stand of claim 12, further comprising a common bolt that attaches both the first lower side panel and the first upper side panel to the middle shelf.

15. The television stand of claim 12, wherein the first lower side panel, the first upper side panel, the second lower side panel, and the second lower side panel each define a plurality of openings to facilitate natural airflow therethrough.

16. The television stand of claim 12, wherein the base, the middle shelf, the top shelf, the first lower side panel, the second lower side panel, the first upper side panel, and the second upper side panel are each made of metal to promote heat dissipation.

17. The television stand of claim 12, further comprising a plurality of acorn nuts protruding upward from the top shelf to help prevent the television from sliding off the top shelf and to help bolt the top shelf to the first upper side panel and the second upper side panel.

18. The television stand of claim 12, wherein the top shelf defines a hexagon with two substantially 90-degree angles and two pairs of substantially parallel sides.

19. The television stand of claim 12, wherein the middle shelf defines a hexagon with two substantially 90-degree angles and two pairs of substantially parallel sides.

20. The television stand of claim 12, wherein the base defines a hexagon with two substantially 90-degree angles and two pairs of substantially parallel sides.

21. The television stand of claim 12, further comprising a central support that includes one end pressed up against the middle shelf to help support at least one of the middle shelf and the top shelf.

22. The television stand of claim 21, further comprising a resilient pad disposed at the one end to promote a frictional grip between the central support and the middle shelf.

23. The television stand of claim 21, wherein the central support has a material thickness that is substantially equal to that of at least one of the base, the middle shelf, the top shelf, the first lower side panel, the second lower side panel, the first upper side panel, and the second upper side panel.

24. The television stand of claim 21, further comprising:

a lower back panel resting on top of the base and being bolted to the base and the middle shelf;

an upper back panel resting on top of the middle shelf and being bolted to the middle shelf and the top shelf;

a lower cable guard bolted to the lower back panel and the base, wherein the lower cable guard defines a lower cable-receiving opening and protrudes horizontally beyond an outer perimeter of the base; and an upper cable guard bolted to the upper back panel and the middle shelf, wherein the upper cable guard defines an upper cable-receiving opening and protrudes horizontally beyond a second outer perimeter of the middle shelf.

* * * * *

UNITED STATES PATENT AND TRADEMARK OFFICE

CERTIFICATE OF CORRECTION

PATENT NO. : 6,672,465 B2
DATED : January 6, 2004
INVENTOR(S) : White et al.

It is certified that error appears in the above-identified patent and that said Letters Patent is hereby corrected as shown below:

Column 6,
Line 29, please delete “but space apart” and insert -- but spaced apart --.

Signed and Sealed this

Fifteenth Day of June, 2004

JON W. DUDAS
*Acting Director of the United States Patent and Trademark Office*